US007877843B2

(12) United States Patent
Holland-Letz

(10) Patent No.: US 7,877,843 B2
(45) Date of Patent: Feb. 1, 2011

(54) HANDLE

(75) Inventor: Martin Holland-Letz, Neustadt (DE)

(73) Assignee: Felo-Werkzeugfabrik Holland-Letz GmbH, Neustadt (DE)

( * ) Notice: Subject to any disclaimer, the term of this patent is extended or adjusted under 35 U.S.C. 154(b) by 0 days.

(21) Appl. No.: 11/767,533

(22) Filed: Jun. 25, 2007

(65) Prior Publication Data

US 2007/0256276 A1 Nov. 8, 2007

Related U.S. Application Data

(63) Continuation of application No. PCT/EP2005/014003, filed on Dec. 23, 2005.

(30) Foreign Application Priority Data

Dec. 23, 2004 (DE) ..... 10 2004 063 349
Aug. 9, 2005 (DE) ..... 10 2005 037 504

(51) Int. Cl.
*B25G 1/01* (2006.01)

(52) U.S. Cl. ..... 16/436; 16/430

(58) Field of Classification Search ..... 016/436, 016/430, 431, 421, 435, DIG. 12, DIG. 19, 016/DIG. 18; 15/143.1, 144.1, 145, 443; 81/177.1, 177.6, 489; 156/212, 218; 473/300, 473/301, 302, 303; 30/322, 323, 340; 135/24, 135/25, 25.41, 25.4; D3/5–6, 10, 12; D8/81–83
See application file for complete search history.

(56) References Cited

U.S. PATENT DOCUMENTS 2,743,749 A * 5/1956 Lowry ..... 81/177.1
2,871,899 A * 2/1959 Coyle et al. ..... 81/177.1
3,189,069 A * 6/1965 Stowell ..... 81/177.1
3,343,577 A * 9/1967 Wagner ..... 81/177.1
4,038,719 A * 8/1977 Bennett ..... 16/430
5,520,073 A * 5/1996 Bakula et al. ..... 81/63.1
5,740,586 A * 4/1998 Gomas ..... 16/436
6,170,123 B1 * 1/2001 Holland-Letz ..... 16/436
6,220,128 B1 4/2001 Hu
6,490,761 B2 * 12/2002 Durrant ..... 16/436
6,647,582 B1 * 11/2003 Rechelbacher ..... 15/143.1
6,749,790 B1 * 6/2004 Lieser et al. ..... 264/279
6,976,413 B2 * 12/2005 Hsieh ..... 81/492
7,040,598 B2 * 5/2006 Raybuck ..... 251/149.1
7,093,523 B2 * 8/2006 Gamba et al. ..... 81/489
7,409,747 B2 * 8/2008 Chen ..... 16/430
2003/0110585 A1 * 6/2003 Rechelbacher ..... 15/143.1
2004/0050205 A1 * 3/2004 Putnam ..... 74/558

(Continued)

FOREIGN PATENT DOCUMENTS

CA 2209885 1/1999

(Continued)

*Primary Examiner*—Chuck Y. Mah
(74) *Attorney, Agent, or Firm*—Squire, Sanders & Dempsey, L.L.P.

(57) ABSTRACT

The present invention relates to a handle, in particular for use in a screwdriver. Such handle comprises an outer region having a first stiffness and an inner region comprising a second stiffness. According to the invention the second stiffness is smaller than the first stiffness. The inner region might be built with chambers and ribs wherein the chambers might be hollow or filled with a soft material, e.g. a gel or a soft porous or non-porous plastic material.

39 Claims, 9 Drawing Sheets

U.S. PATENT DOCUMENTS

| | | | | |
|---|---|---|---|---|
| 2004/0217555 | A1* | 11/2004 | Willat et al. | 277/645 |
| 2004/0220000 | A1* | 11/2004 | Falone et al. | 473/568 |
| 2006/0037176 | A1* | 2/2006 | McGuyer et al. | 16/430 |

FOREIGN PATENT DOCUMENTS

| | | | |
|---|---|---|---|
| DE | 9202550 | U1 | 6/1992 |
| DE | 4304965 | A1 | 9/1993 |
| DE | 29515833 | U1 | 1/1996 |
| DE | 29517276 | U1 | 1/1997 |
| DE | 19539200 | A1 | 4/1997 |
| DE | 19732421 | C2 | 2/1999 |
| DE | 29900746 | U1 | 6/1999 |
| DE | 29904082 | U1 | 7/1999 |
| DE | 29904043 | U1 | 10/1999 |
| DE | 10113368 | A1 | 10/2001 |
| EP | 0 627 974 | B1 | 12/1994 |
| JP | 2000308981 | A * | 11/2000 |

* cited by examiner

HANDLE

CROSS REFERENCE TO RELATED APPLICATION

This is a continuation application of international application PCT/EP2005/014003, designating the United States of America, filed Dec. 23, 2005, the entire disclosure of which is incorporated herein by reference.

FIELD OF THE INVENTION

The present invention generally relates to a handle for a screwdriver, a screw clamp or another device wherein a torsional moment is applied by a user upon the outer surface of the handle and wherein the applied torsional moment is transferred to an output element located inside the handle, e.g. a functional part or a shank of a screwdriver. According to another aspect, the invention relates to a method for manufacturing handles of the above type.

BACKGROUND OF THE INVENTION

First improvements of handles for screwdrivers made of a hard plastic material have been suggested in U.S. Pat. No. 2,871,899 directed to improvements of the haptics of the handle. Here, a separate cover layer for the handle made of a soft plastic material is slid on a core of the handle. For a transfer of torsional moment in circumferential direction both the core of the handle and the cover layer of the handle comprise correlating profiles for a positive engagement. The use of the soft plastic material for the cover layer of the handle improves the grip of the handle. However, tests in the practical field have shown that the soft cover layer separates from the hard core under heavy loads and builds folds. The aforementioned separation of the cover layer from the core of the handle is also called "tumbling". In particular intense use of such handle leads to the painful development of blisters at the palm of the hand of the user and to increased stresses of the bones of the hand that might lead to inflammations.

In order to avoid the aforementioned drawbacks, in the following it has been suggested to adhere the core of a handle with the cover of the handle wherein the soft plastic only builds segments of the outer surface of the handle or completely covers the handle in circumferential direction, cp. DE 92 02 550 U1, DE 43 04 965 A1, DE 295 15 833 U1, DE 195 39 200 A1, DE 295 17 276 U1, DE 299 00 746 U1. Today, handles of these types are manufactured by injection moulding of plastic materials. These known embodiments lead to good ergonomics and haptics of the handles for tools of increased quality. For such handles made of two components of different plastic materials a tool or functional part is anchored within a core made of a hard plastic material and the core is surrounded by injection moulding of a cover layer made of a soft plastic material, cp. European Patent No. EP 0 627 974 B1. The cover layer made of the soft plastic material comprises a certain elasticity and leads to a more pleasant grip than a handle which is formed only by a hard plastic material. Furthermore, the soft plastic material might also comprise a larger friction coefficient than a hard plastic material. As a consequence, by means of such "two-components-handle" larger torsional moments might be transferred than in case of using a handle with the same size but only made of a hard plastic material. This is in particular important for handles used for screwdrivers, screw clamps and the like.

German Patent Application No. DE 101 13 368 A1, corresponding to U.S. Pat. No. 6,220,128 B1, is directed to a handle for a hammer, wherein the handle comprises hollow chambers. Such chambers increase the elasticity of the handle. Such increased elasticity is used for improving the elastic dampening of shocks and impulses in the transfer of a force from the head of the hammer to the hand of the user. A similar embodiment is shown in German Patent No. DE 197 32 421 C2 corresponding to Canadian Patent Application No. CA 2,209,885 A1.

Similar in German Gebrauchsmuster No. DE 299 04 043 a handle is used for damping oscillations of an impact drilling machine, a grinding machine and the like.

SUMMARY OF THE INVENTION

The present invention relates to a handle designed and configured to be used for a hand tool. The handle comprises an inner region as well as an outer region built by a cover layer. The inner region comprises chambers located equidistant in circumferential direction of said handle. According to an alternative embodiment, the inner region comprises one single chamber being continuous in circumferential direction of said handle. The outer region might be built by a cover layer. The outer region forms an outer surface of said handle that might be used to apply a torsional moment from a user of said handle to the handle. The outer region, e.g. the cover layer, is built with a material having a first stiffness. Such outer region is adhered or bonded with the inner region. According to one aspect of the invention, some of the chambers, all of the chambers or one single chamber is partially or completely filled with an elastic plastic material, wherein the material comprises a non-porous structure and has a second stiffness. According to the invention, the stiffness of the material located within the chamber is smaller than the first stiffness of the outer region.

In the following description for simplicity the invention is described for a use of a handle of a screwdriver. However, in a similar manner the description and the features might be transferred to a handle for use with a screw clamp or another device for transferring a torsional moment applied upon an outer surface of said handle in order to transfer such torsional moment to an output element located within the handle.

One particular embodiment of the invention is directed to the finding that the design of a handle basing on the embodiments known from the above mentioned prior art leads to the following conflict of interests:

- A reduction of the stiffness of the material building the cover layer of the handle increases the adaptation of the cover layer to the hand of a user, to different hands with different sizes and increases the contact area between the hand of the user and the cover layer.
- On the other hand side, the materials have to transfer large torsional moments. Additionally, the outer surface of the cover layer should be resistant also in rough conditions. These aims require a hard or stiff material for the cover layer.

For the solutions known from prior art, the aforementioned conflict or interests is considered by optimizing the stiffnesses and the thickness of the used layers individually for the different embodiments. According to another solution known from prior art, the outer surface of the cover layer comprises different parts, wherein parts with large stiffnesses are used for the transfer of the torsional moment, whereas parts with smaller stiffnesses are provided for improving the haptics of the handle. Known two-component-handles, e.g. according to DE 35 25 162, are not resilient over the whole outer surface due to the fact that a hard core of the handle builds a part of the outer surface and only the other remaining parts of the outer surface of the handle are covered by a soft plastic material. Furthermore, the cover layer made of a soft plastic material for handles known from prior art comprises only a small thickness, e.g. 1.5 to 3 mm, so that the deformation of such cover layer is limited. Additionally, the configuration of the cover layer with a soft plastic material makes the handle prone to damages.

According to the present invention, it is suggested to provide the handle with an outer region comprising a closed cover sheet with a closed outer surface that interacts with the hand of the user. Such outer region is built with an elastic material having a first stiffness. The outer region might be built as an integral cover layer or might be built with an outer surface having different parts wherein at least one part is built by a hard plastic material whereas at least one other part is built with a soft plastic material. The different parts might be positioned in an intermittent fashion in longitudinal direction and/or circumferential direction.

In the present application, the term "at least one chamber" or "at least one of said chambers" is used for one single chamber provided at the handle, all of the chambers in case of a plurality of chambers or only a part of a plurality of chambers.

The dimensions of the outer region, the inner region and the chamber(s) as well as the number and the positions of the chambers as well as the first and second stiffness might be chosen such that under typical forces applied by the hand of a user to the outer surface of the handle the outer region is deformable. Such deformation of the outer region coincides with a deformation of the chambers with the material located inside the chambers. Accordingly, the inner region is not designed for supporting the outer region as stiff as possible in order to avoid any deformation of the inner region. Instead, the elastic inner region builds a support that is resilient and deformable in radial direction under typical forces acting in radial direction. On the other hand, the hand of the user interacts with the outer region having a larger first stiffness wherein such increased stiffness might be used for a good transfer of the applied torsional moment. In summary, the prior art relies on the prejudice that the stiffness of the used materials of a handle should increase in radial inner direction. Instead, the present invention for the first time suggests that the stiffness decreases—at least in parts of the circumference—in radial inner direction.

It has been discovered that the fingers of a user might apply a larger specific normal force than the palm of the hand of the user. So, according to the invention, the outer region might deflect in the contact area with the fingers with larger deflections than in the region of the palm leading to an increased contact area for the fingers and to the possibility of applying a larger force from the fingers into the handle. Due to the different extent of the deformation, the cross-section might be deformed such that the cross-section of the handle is more convex in the contact area with the palm which corresponds to the natural form of the palm. In general, according to the invention, the contact area between the palm and the handle is increased with respect to the handles known from prior art.

German Patent Application No. DE 101 13 368 A1 and German Patent No. DE 197 32 421 C2 disclose handles for a hammer. When using a hammer, the user accelerates the handle during the strikeout of the hammer in order to reach a hitting velocity of the hammer defining the impulse of the stroke of the hammer. However, the stroke should not be transferred to the hand of the user. In order to damp such stroke, the aforementioned documents suggest providing an air cushion which is located on the upper side or lower side of the handle in striking direction. Such air cushion undergoes a deformation during the stroke and builds a spring and/or a damper in the force transfer between the hammer and the user. Differing from such embodiments, a handle according to the invention is used for a screwdriver wherein a damping of any stroke is not necessary. Instead, usually screwdrivers require a stiff transfer of a torsional moment in circumferential direction as well as enhanced possibilities for an adaptation of the handle to the hand of a user. For that aim, the mentioned chambers might be located equidistant in circumferential direction or extend as one single chamber in a continuous fashion in circumferential direction.

According to another embodiment of the invention, the dimensions and the stiffnesses are chosen such that the stiffness of the handle in radial direction is smaller than the stiffness of the handle in circumferential direction. This means that applying forces to the handle in circumferential direction leads to deformations being smaller than the deformation caused by a radial load applied to the handle under elastic deformation of at least one chamber. The deformation in circumferential direction is in particular with a factor of about 2, 5, 10 or 30 smaller than the corresponding deformation in radial direction.

According to another embodiment of the invention, at least one chamber is hollow. In such case the second stiffness for such hollow chamber equals 0. This means that the outer region or cover layer are not supported but have "free boundary conditions". In spite of using a material with a large first stiffness, the thickness of the cover layer might be chosen to be small such that the outer region might deflect under decreasing the cross-section or the radial extension of the hollow chambers.

For another embodiment, the chambers might be filled with any material having a second stiffness. Such material might be a soft plastic material injection-moulded into the chamber, a powder or a gel wherein the aforementioned materials might completely or partially fill the chambers.

During any deformation of the outer region the volume of the chambers might remain constant, wherein parts of the chamber are deformed in radial inner direction leading to a decrease of the volume of the chambers in that region. Other regions of the same chambers might expand in radial direction by the same amount so that the overall volume remains constant. However, it is also possible that a plurality of chambers is interconnected with each other, so that it is possible that the volume of one chamber is decreased, wherein at least one other chamber increases its volume under the radial load. As a transfer means for the aforementioned changes of the volume according to one embodiment of the invention a gel might be used which is pushed out of one chamber or one region of a chamber and pushed into another region of the same chamber or into another chamber which is subjected to smaller forces of the hand of the user. In such manner, the adaptation process to the hand of the user is not solely caused by a deformation in radial inner direction but also caused by a deflection of other parts of the handle in radial outward directions.

The chambers might be oriented in any direction. A longitudinal axis of the chambers might be slanted in a projection with respect to the longitudinal axis of the handle or might be oriented transverse to the longitudinal axis. It is also possible that at least one chamber has a spiral configuration twisting around the longitudinal axis of the handle. According to one embodiment of the invention, the at least one chamber extends—at least in some regions—in longitudinal direction of the handle. By means of such chambers it is possible to influence the stiffness in a circumferential segment of the handle. Casting cores used for forming the chambers during the injection moulding process might be removed in a simple fashion in longitudinal direction. It is also possible that a plurality of chambers is positioned one behind another in longitudinal direction. This might be the case for an embodiment with the outer region being built by an integral cover layer building a cover which is slid upon a core of the tool.

According to another embodiment of the handle, the chambers are contoured in radial direction along the longitudinal axis. By means of such contour the parts of the chambers located more outside in radial direction might delimit the outer regions to a small wall thickness. Accordingly, by means of the designs of the chambers the wall thickness of the outer region might be affected. By this design areas with large deformations of the outer region might be provided.

In the same manner, the deformations and the stiffnesses of the handle might be influenced in case of the outer contour of the chamber being different than the outer contour of the outer surface of the handle. On the other hand side, due to the use of contoured chambers it is possible to provide parts of the inner region with an increased radial extension. Such parts might be used for connecting a functional part of a screwdriver with the inner region of the handle.

In case that it is of advantage to use a constant wall thickness of the outer region and the cover layer adjacent to the chambers, the contour of the chamber might correspond to the contour of the outer surface of the handle.

According to another embodiment of the invention, the chambers might comprise a cross-section which is constant in longitudinal direction facilitating a removal of any casting cores used during the manufacturing process of the handles or during the manufacturing process of parts of the same.

The chambers might also comprise a cross-section that changes in longitudinal direction, wherein such changes of the cross-section provide possibilities for influencing the wall thicknesses, stiffnesses and the deformations in radial direction of the handle and the outer and inner region.

The chambers might be provided by milling or drilling after the manufacturing process of the inner region. In case of at least manufacturing the inner region of the handle by means of injection moulding, it is possible to provide the chambers by means of casting cores used during the injection moulding process. In case that it is not possible to remove the casting cores without applying increased removal forces or deformations of the surrounding areas along a translational or curved path due to the contour of the chambers and/or due to a variable cross-section of the casting cores, it is possible that the inner region and/or the casting cores are elastic so that the removal of the casting cores is done under elastic deflection of the inner region and/or of the casting cores. In case that the handle is built with a core and a cover layer the inner region might be built by the core and/or the cover layer. According to one embodiment of the handle, the inner region is built in a radial transitional region between the core of the handle and the cover layer. In such case, the chambers in cross-section might be limited both by the core and the cover layer. This means that it is not necessary to provide the chambers within the core or within the cover sheet only. Instead, the chambers are built with recesses, grooves or slots of the core and of the cover layer. In case of both the core and the cover layer comprising grooves or recesses, such grooves or recesses might be combined to the full cross-section of the chambers. Such grooves, slots or recesses might be manufactured by corresponding protrusions or ribs of a mold throughout the injection moulding process for the core of the handle and/or the cover layer. However, it is also possible to manufacture such grooves, recesses or slots subsequent to the manufacturing process of the core of the handle or the cover layer, e.g. by milling.

In another handle according to the invention, adjacent chambers are separated by ribs. By means of such ribs, the material properties of the ribs, the profile of the ribs in cross-section of the handle and/or the extension of the ribs in circumferential direction and in radial direction another means for influencing the haptics and the stiffnesses of the handle is given. On the other hand, the ribs might connect the outer region with a central region or core of the handle located inside the inner region. By means of the design of the ribs the transfer characteristic of the torsional moment from the outer region via the ribs to the central region, e.g. a functional part of a screwdriver or a core, might be influenced.

The ribs might be oriented approximately in radial direction. For such embodiment any forces of the use of the user acting in radial inner direction are directed in longitudinal direction of the ribs. For the transfer of a torsional moment, the ribs are subjected to sheering stresses in circumferential direction as well as a bending moment with respect to an axis which is parallel to the longitudinal axis of the handle.

However, it is also possible that the ribs in a cross-section of the handle are inclined with respect to a radial orientation under an angle of inclination $\alpha$. By means of the choice of the angle of inclination $\alpha$ another design feature is provided for influencing the haptic properties and the stiffness. This is due to the fact that the angle of inclination $\alpha$ influences the normal force acting in the longitudinal direction of the ribs in the cross-section, the aforementioned bending moment and the aforementioned sheer stresses during the use of the handle.

According to another embodiment of the invention, ribs with different angles of inclination $\alpha$ are provided. In case of a first angle of inclination $\alpha$ being optimal for the transfer of a torsional moment in a first circumferential direction other ribs having angles of inclination $\alpha$ with the same amount but opposite direction might be used for the transfer of a torsional moment directed in the opposite direction.

The chambers might be formed by casting cores introduced or removed from a front or back face of the handle so that after the removal of the cores the front or back face of the handle comprises at least one opening. Such openings might be closed by means of a cap. The cap is used for closing or sealing the chambers. However, it is also possible that such cap is multifunctional and also builds an outer surface at the end of the handle designed and arranged for a contact with the hand of a user for the application of forces in longitudinal directions of the screwdriver pressing the functional part of the screwdriver against a screw.

According to another embodiment of the invention, the invention suggests to provide the cap with a rigid or elastic closing element closing the aforementioned opening(s). Such closing element might be configured to close only one single chamber or might be one closing element used for closing a plurality of openings for a plurality of chambers. For one example, the closing element might be a ring. Such ring or closing element might also be multifunctional in case of the ring comprising a color code in cases where handles of different types are used. Here the color code indicates the type of handle.

According to another embodiment of the handle, the cap might be rotatable. Such embodiment is of advantage in case of applying normal forces upon the cap directed in longitudinal direction of the handle with coinciding rotation of the handle due to the torsional moment applied to the handle.

The cap might also be connected with the core of the handle or the cover layer of the handle by means of positive engagement, e.g. by means of a locking connection, a thread or the like. According to another embodiment, frictional engagement is used for connecting the cap with other parts of the handle.

According to another embodiment of the invention, the cap is adhered or bonded to the other parts of the handle. It is also possible that the cap is connected with other elements of the handle, in particular the core of the handle and/or the cover layer of the handle, by injection-moulding.

When choosing the material for the outer region, a soft plastic material might be used comprising a hardness of 30 or 40 to 105 Shore A, wherein according to one embodiment a soft plastic material with 30 or 50 to 85 Shore A, in particular 55 to 83 Shore A, is used.

According to another embodiment of the invention, the cross-section of the chambers is limited in circumferential direction by means of the ribs and in radial outward direction by means of the cover layer. The outer surface of the handle might be built by the outer surfaces of the ribs and transitional regions extending between the outer surfaces of the ribs. Such transitional regions might be built by "stripes" connecting the ribs. Such stripes might be stiff in order to provide a stiff transfer of a torsional moment. Those transitional regions are supported by the stiff ribs leading to a stiff transfer of forces in circumferential direction applied upon the transitional regions to the ribs. The ribs transfer the torsional moment to a core or a functional part or an output element leading to a good transfer of the torsional moment, wherein at the same time a good deformation of the handle in radial direction might be provided.

Extended options for the choice of the stiffnesses are given in case of the ribs, the material located in the chambers and the cover layer being built with materials comprising different stiffnesses. It is possible that the ribs are made of the same material as the core of the handle. The ribs and the core of the handle might be manufactured by one single step of an injection moulding process or the ribs might be built from another material than the core of the handle.

For another handle, a central region of the outer surface of the handle might be built in circumferential direction with the outer surfaces of the ribs and the transitional regions in an alternating fashion. Accordingly, such central region provides the capacity of a good transfer of a torsional moment. In such central region, both a good transfer of torsional moments as well as a good adaptation to a hand of the user is provided. The central region might comprise the largest outer diameter of the outer surface of the handle. Adjacent to such central region there is a front region and a back region or end region. In the front region or back region, the transitional regions extend around the entire periphery of the outer surface of the handle. Here the transitional region builds a long-term, stable and continuous front region or back region. For such front region or back region, a decreased radial elasticity might be acceptable due to the fact that the requirements for a radial adaptation of the handle to the hand of a user are decreased which is due to the fact that the diameter of the handle in such region is smaller or only the outer parts of the hand contact these areas without the need of a transfer of large forces.

For the manufacturing process of the handle, the invention suggests to first manufacture a core of the handle which might be done by injection moulding. A core of the handle might comprise a recess for introducing an exchangeable functional part of the tool. It is also possible that the core of the handle is directly injection-moulded upon the functional part. Subsequent or in a parallel manufacturing step casting cores are arranged under orientation parallel to a longitudinal axis. The casting cores are positioned equidistant from each other in circumferential direction. The casting cores are, in particular together with the core of the handle, positioned within a cavity of a mold. In the cavity, the casting cores (and maybe also the core of the handle) are covered with the material building the cover sheet in an injection moulding process. In a subsequent manufacturing step that is started after the hardening process of the material of the cover layer has finished, the casting cores are removed by movement of the casting cores versus a front face or back face of the material building the cover layer. Such movement frees chambers and openings located in the front face or back face. Subsequently, the aforementioned openings or the chambers are at least partially closed or filled.

According to one embodiment of the manufacturing process the closing of the openings, so the closing of the chambers is done by use of a cap. Further possibilities for an influence of the stiffnesses are given by at least partially filling the chambers with a material comprising the second stiffness.

The core of the handle and the cover layer with the chambers might be manufactured in separate manufacturing steps and might be combined or connected with each other after finishing the hardening process. In an alternative embodiment, the cover layer might be adhered or bonded with the core of the handle when covering the casting cores throughout the injection moulding process.

A core board or core pusher might be used connected with the plurality of casting cores, wherein the casting cores are connected under orientation of the casting cores parallel to each other and parallel to the longitudinal axis and comprising a constant radial distance from the core of the handle. In case of the use of a core board or core pusher, the casting cores might in a first manufacturing step be moved over the core of the handle. In a second manufacturing step the cover layer is injection-moulded upon the core of the handle wherein the chambers are formed by the casting cores into the injected material. After the hardening process has finished the casting cores might be moved by one single movement of the core board or core pusher out of the material building the cover layer.

According to another embodiment of the manufacturing process the cap comprises a closing element. Such closing element might be positioned together with a core of the handle and the cover layer of the handle within a cavity after the removal of the casting cores from the inner region. In such cavity, the cap is injection-moulded wherein the injected material presses the closing element against the core of the handle or the cover layer in order to close the openings. Throughout the injection moulding process the material adheres to the core of the handle and/or the cover layer as well as to the closing element.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
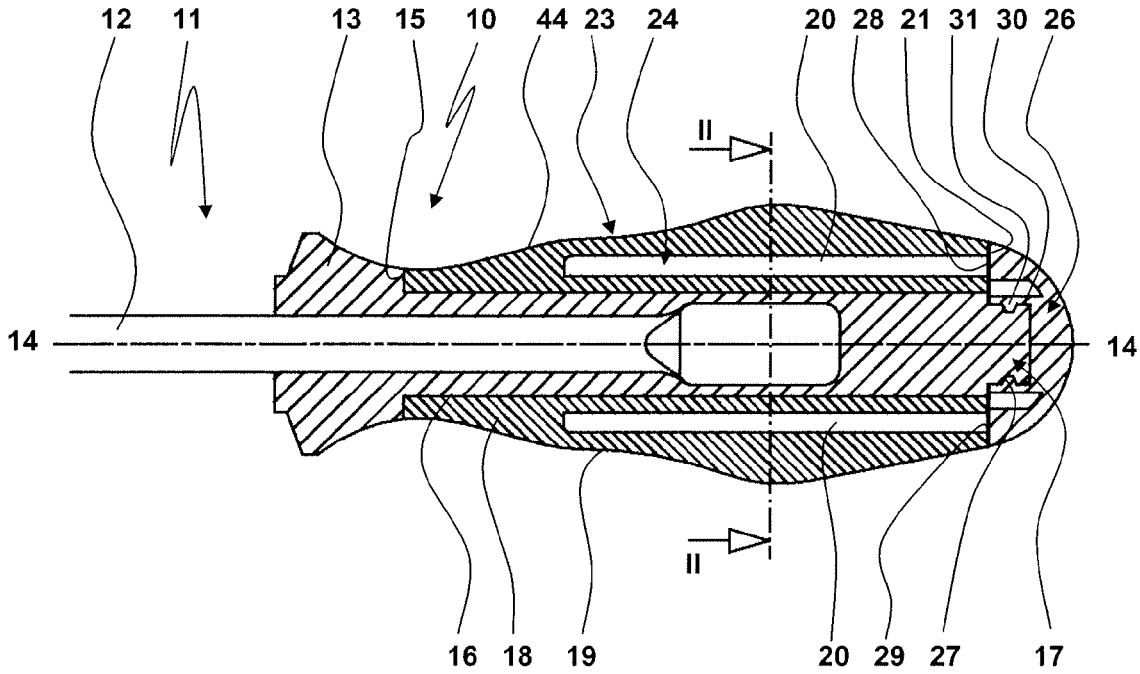
FIG. 1 shows a handle of a screwdriver in a longitudinal sectional view.

Referring now in greater detail to the drawings, FIG. 1 shows an example of a handle 10 for a screwdriver 11, wherein such handle might also be used for any other tool.

The screwdriver 11 comprises a functional part 12 which is inserted into the handle 10 in a fixed or exchangeable manner. The functional part 12 might comprise a functional tip with a suitable shape for the interaction with a screw, wherein such functional tip is not shown in FIG. 1. According to an alternative embodiment, the functional part 12 might comprise a suitable holding device for a bit. The handle 10 comprises a core 13 of the handle. The core 13 houses the functional part 12 with a suitable connection for transferring a torsional moment as well as normal forces directed in the direction of a longitudinal axis 14-14. The core 13 of the handle might have a cylindrical outer surface 16 with a shoulder 15. The core 13 of the handle ends with a protrusion 17 adjacent to the cylindrical surface 16. The surface 16 is covered with a cover layer 18 manufactured by injection moulding wherein the cover layer 18 is built with a soft plastic material. The outer surface of the cover layer 18 and the free outer surface of the core 13 of the handle build a continuous outer surface 19 wherein the outer contour 44 of the outer surface 19 is adapted for good ergonomics for hands of users with different sizes.

Figure 2:
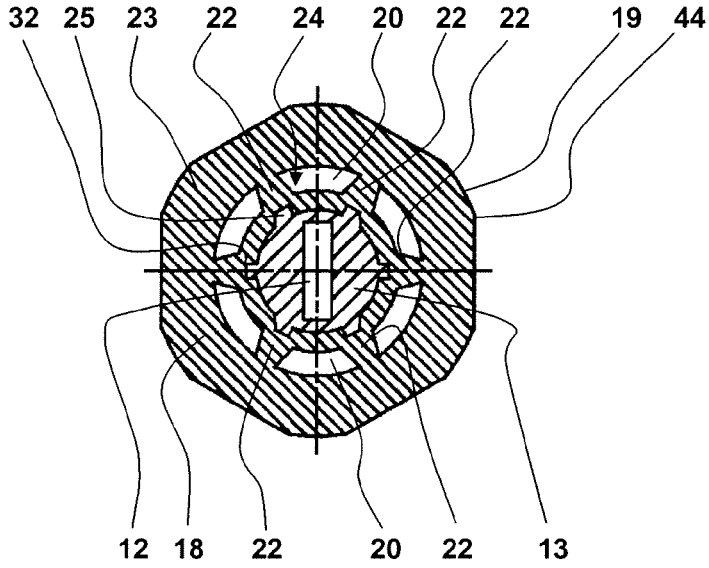
FIG. 2 shows a cross-section II-II of the handle according to FIG. 1.

As can be seen from FIG. 2, the handle 10 comprises six chambers 20 positioned with constant distances between adjacent chambers 20 in circumferential direction. The chambers 20 are oriented parallel to the longitudinal axis 14. The chambers 20 depart from the rear region 21 of the cover layer 18. The chambers 20 have a cross-section in the form of a ring segment and are separated from adjacent chambers by ribs 22. For the embodiment according to FIG. 2, the ribs 22 are tapered in radial outward direction. However, the ribs might comprise any different contour. Instead of the six chambers 20 shown in FIG. 1, any different number of chambers 20 might also be provided.

In a region located radially outside from the chambers 20 the cover layer 18 builds an outer region 23 whereas an inner region 24 is built with the ribs 22 and chambers 20. The core 13 of the handle and the functional part 12 located within the core 13 are located inside the inner region 24. According to FIG. 2, the linkage between the core 13 of the handle and the cover layer 18 might be strengthened by ribs 25 provided at the core 13 of the handle. The ribs 25 of the core 13 are housed within corresponding radial recesses 32 in the form of grooves of the cover layer 13. The connection between the core 13 of the handle and the cover layer 18 might be built by positive engagement, frictional engagement and/or adhesive bondage. According to one embodiment, the cover layer 18 is injection-moulded upon the core 13 of the handle.

The protrusion 17 might comprise a cylindrical shape with a continuous groove 27 extending in circumferential direction. A cap 28 is (in a first approximation) semi-spherical with a front surface 28 that closes openings 29 of the chambers 20 built in the rear surface 21. Inside the cap 26 there are elastic arms 30 or an elastic sleeve. Such elastic element(s) might undergo an elastic extension in radial outward direction and comprises resting or locking elements 31 at the inside that—due to the elasticity of the elastic arms 30 or the elastic sleeve—interlock with the groove 27 in the position shown in FIG. 1.

Figure 3:
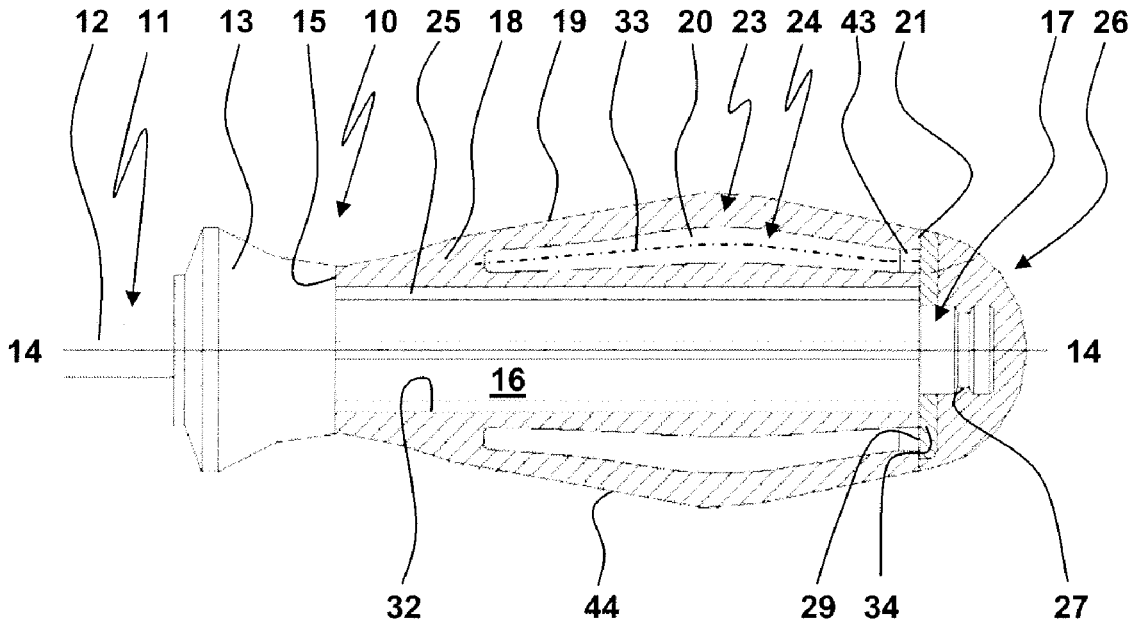
FIG. 3 shows another embodiment of a handle for a screwdriver in a longitudinal sectional view.

For the alternative embodiment shown in FIG. 3, the chambers 20 of the handle 10 comprise a longitudinal axis 33 being contoured in radial outward direction. Additionally, the radial extension of the chambers increases versus the central region of the chambers 20. In such case the openings 29 are closed by means of a ring washer 34 which is attached or pinned upon the protrusion 17. For the manufacturing process of cap 26, the core 13 of the handle and the cover layer 18 are located within a mould for injection moulding, wherein the cavity of the mould builds a hollow volume having the shape of cap 26. Such hollow volume is filled by injection moulding with the plastic material for the cap 26. During an increase of the pressure during the injection process for the plastic material, the ring washer 34 is pressed against the rear surface 21. In such case, the cap 26 is adhesively bonded both with the protrusion 17 as well as the ring washer 34. According to one embodiment, the ring washer 34 is built with a plastic material. Additionally, ring washers 34 for handles 10 of different types of screwdrivers might have different colors so that the ring washers 34 of different colors build a color code for the handles 10. In such case, the outer circumference of the ring washer 34 is part of the outer surface 19 of the handle 19 (see the upper half-plane according to FIG. 3). In case that the aforementioned color code is not used, it is also possible that the outer circumference of the ring washer 34 is covered by the material of the cap 26 throughout the injection moulding process (see lower half plane according to FIG. 3). FIG. 3 shows an annular ring groove 43 connecting the chambers 20 with each other. Such connection might be used for a pressure balance within the chambers 20, in particular in case of a gel being located within the chambers 20.

Figure 4:
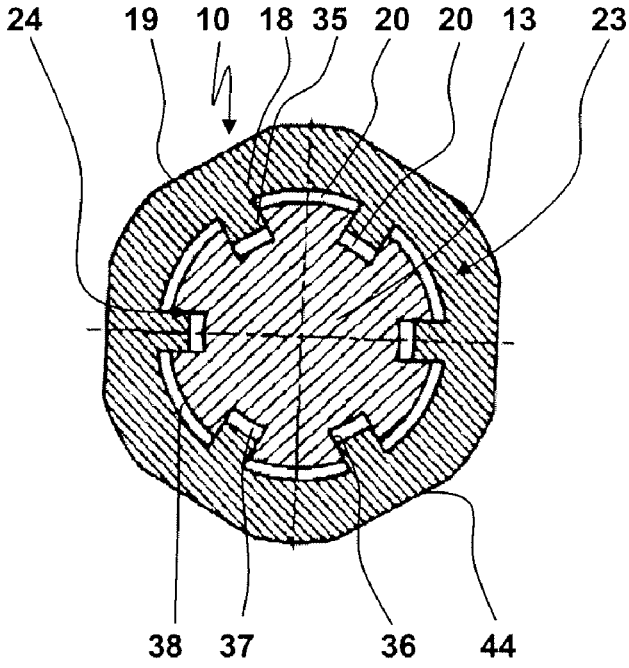
FIG. 4 shows another embodiment of a handle in a cross-sectional view.

In an alternative embodiment of the invention shown in FIG. 4, the inner region 20 is stepped in circumferential direction. An inner surface of the cover layer 18 comprises protrusions 35 or ribs directed in radial inner direction. Such protrusions are housed without any play in circumferential direction within recesses 36 or grooves, wherein the cross-sections of the protrusions 35 or ribs on the one hand side and the recesses 36 or grooves on the other hand side correlate with each other. The front surface of the protrusion 35 pointing in radial inner direction and the bottom of the recess 36 comprise a radial play 37, whereas the inner surface of cover layer 18 and the outer surface of the core 13 of the handle comprise a radial play 38. In case of the plays 37, 38 being of the same size, such plays are removed by the same deformation of the cover layer 16. In such case, an increase of the stiffness of the handle under a radial load is provided by means of the aforementioned geometrical features. However, in case of the plays 37 and 38 being of different sizes, also a non-linear increase of the stiffness might be provided. The cover layer 18 and the core 13 of the handle with the protrusions 35 and recesses 36 build a kind of indentation with a rectangular profile. In circumferential direction, these indentations contact with each other building a sliding contact in longitudinal direction for the assembly. One advantage of such embodiment might be that under an increase of the radial load applied to the handle 10, the contacting areas of the aforementioned indentations increases so that the contact areas being responsible for a transfer of the torsional moment increase in size with an increase of the radial load applied by the hand of a user.

Figure 5:
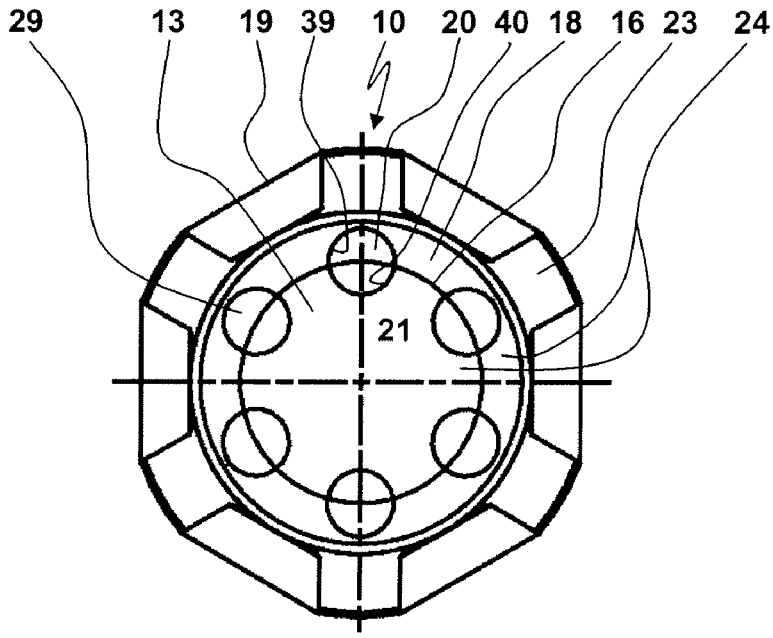
FIG. 5 shows another embodiment of a handle with removed cap in a rear view.

FIG. 5 shows a rear view of a handle 10 without a cap 26 showing the rear surface 21. For the embodiment shown in FIG. 5, the upper half of the chambers 20 is built by a radial recess 39 of the inner surface of the cover layer 18, wherein the recess 39 comprises an approximately semi-spherical shape. The radial inner half of the chamber 29 is built by a recess 40 or groove in the outer surface 16 of the core 13, wherein such groove 40 also comprises an approximately semi-spherical shape. However, the cross-sectional profiles of the recesses 39, 40 might also have any different shape.

Figure 6:
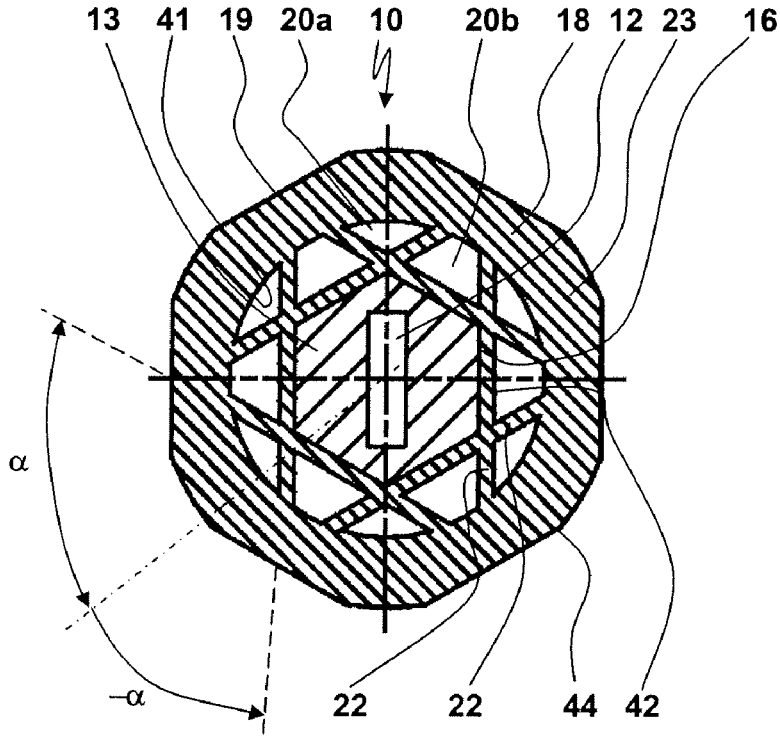
FIG. 6 shows another embodiment of a handle in a cross-sectional view.

In the embodiment shown in FIG. 6, the core 13 of the handle is built—at least in the shown cross-section—with a hexagonal outer contour with constant lengths of the sides of the contour. The outer region 23 is limited in radial inner direction by a circular inner contour 41. Six straight ribs 22 having a constant wall thickness in the shown cross-section abut in a middle region 42 with the outer surface 16 of the core 13 of the handle, intersect each other in the corner regions of the outer surface 16 with adjacent ribs 22 and extend in radial outward direction to the inner contour 41. The ribs 22 are adhesively bounded or injection-moulded with the outer region 23. Such embodiment results in chambers 20*a*, 20*b* having different cross-sections. The chambers 20*a* have a cross-section which is (in a first approximation) triangular, whereas the chambers 20*b* are (in a first approximation) trapezoidal. The wall thicknesses of the ribs might change in longitudinal direction and/or in radial direction as well as the location and/or the orientation of the ribs might change.

Figure 7:
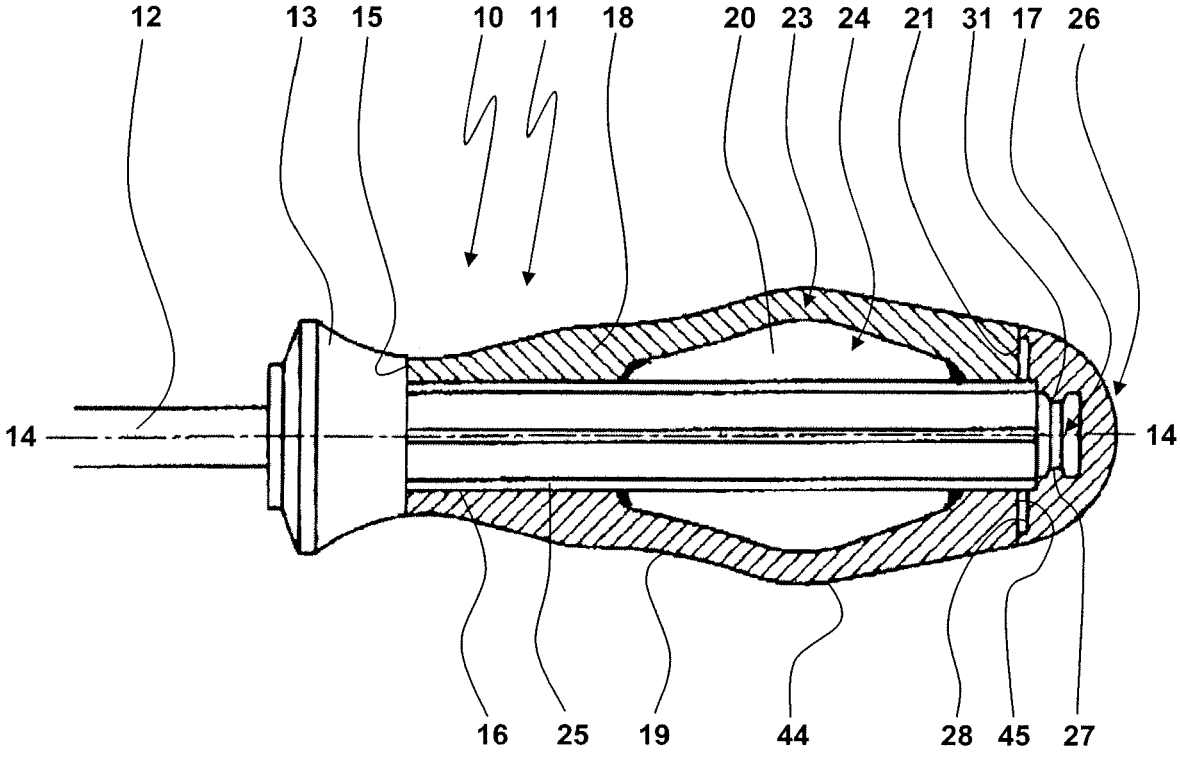
FIG. 7 shows another embodiment of a handle in a longitudinal sectional view.

For the embodiment shown in FIG. 7, the handle 10 comprises only one single chamber 20. However, for such embodiment, such one single chamber is continuous in circumferential direction. The cover layer 18 might be manufactured as a separate part building a kind of sleeve produced by injection moulding. The inner contour of the cover layer 18, e.g. adapted to a core 13 with ribs 25, is formed by a casting core which might be removed from the cover layer 18 after finishing the hardening process of the cover layer 18. Furthermore, the inner contour comprises a bulge or convexity in radial direction limiting the chamber 20 in radial direction. Due to the elasticity of the cover layer 18, it might be possible to pull the casting core for the forming process of the convexity out of the cover layer 18 under an elastic deformation of the cover layer 18.

In a subsequent step of the assembling process, the cover layer 18 is pinned upon or attached by plugging on the core 13 of the handle, wherein ribs 25 of the core 13 are introduced into the corresponding recesses of the cover layer 18 guaranteeing a good transfer of a torsional moment between the core 13 of the handle and the cover layer 18. The rear surface 21 of the cover layer 18 comprises a toothing system 45 for a positive engagement in circumferential direction between cap 26 and cover layer 18.

After the attachment of the cover layer 18 with core 13, the parts are positioned within another mould. The parts fill the cavity except a hollow volume corresponding to the shape of cap 26. During the injection moulding of the plastic material within the cavity, cap 26 is injection-moulded with cover layer 18 as well as core 13 of the handle. For such connection, the core 13 comprises the protrusion 17 with the annular groove 27 providing a good fixation of the cap 26 as well as the cover layer 18 in axial direction. At the same time, additionally to the transfer of a torsional moment by the ribs 25, such torsional moment might be transferred via the toothing system 45 over cap 26 into the core 13 of the handle.

The core 13 of the handle is preferably built with a hard material, e.g. a hard plastic material, wood, metal or aluminum. The core 13 comprises a smaller diameter than cores known for two-component-handles known from prior art. The chambers 20 might have a slightly conical shape in order to ease a removal of the casting cores. For chambers 20 having a variable cross-section, the cross-section of such chamber 20 might have a maximum in the region of the largest outer diameter of the handle, i.e. a central region, and decreases versus regions of the handle with smaller diameters, i.e. the front and rear region.

In a modification of the embodiment shown in FIG. 5, the hollow chambers 20 might be built solely by a recess of the cover layer 18 without any recess of the core 13 or by a recess 40 of the core 13 without any recess 39 of the cover layer 18.

For the manufacturing process of the handle 10 in a first manufacturing step, the core 13 is injection-moulded within a first mould. In a subsequent step, the hardened core 13 is positioned within a second mould. In the cavity of such second mould, the cover layer 18 is injection-moulded upon core 13. Casting cores, in particular a board with a plurality of casting cores, form the chambers 20.

In an alternative manufacturing process for the handle, the cover layer 18 is produced separate from the core 13 of the handle and slid in axial direction upon the core of the handle. Core 13 and cover layer 18 are preferably fixed against each other by means of an adhesive. In such case the cover layer 18 might form the chambers 20 or corresponding grooves. Such grooves might also combine with grooves of core 13 for building chambers of combined cross-sections.

The length of the chambers 20 might approximately correspond with at least the width of the palm of the hand using the handle 10. The chambers 20 are positioned such that they are located within the surface area of the handle 10 being gripped by the user.

In case of the cap 26 not being adhesively bonded with the other parts of the handle 10, it is possible that the cap is rotatable. In such case, cap 26 is subjected to an axial load and contacts the rear surface 21. Between the groove 27 and the resting or locking element 31 as well as between the radial inner front surfaces of cap 26 and the end surface of protrusion 17 a small axial play remains.

Differing from the shown embodiments, it is also possible that a plurality of chambers 20 comprises a decreased radial extension. Chambers are located one behind another in radial direction or with a small shift or offset to an adjacent chamber.

Figure 8:
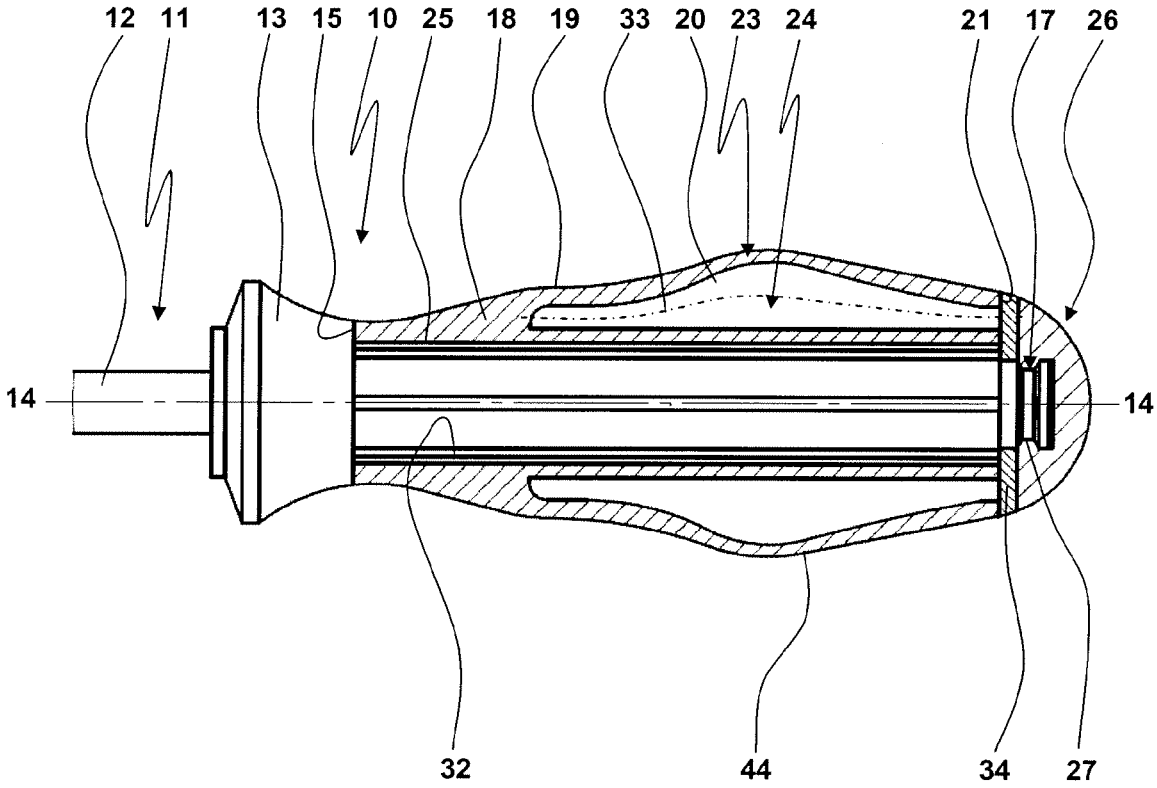
FIG. 8 shows another embodiment of a handle in a longitudinal sectional view.

FIG. 8 shows an embodiment that corresponds in general to the embodiment shown in FIG. 3. However, the contour limiting the chamber 20 in radial inner direction is approximately linear, whereas the contour limiting the chamber 20 in radial outward direction comprises a stronger convexity than the chamber according to FIG. 3. As a result, the wall thickness of the outer region 23 decreases versus the middle region or center region in longitudinal direction of the chamber 20 and reaches a minimum at the point of the maximum of the diameter of the handle 10. Due to the decreased wall thickness, a large elasticity of the handle in radial direction might be provided.

Figure 9:
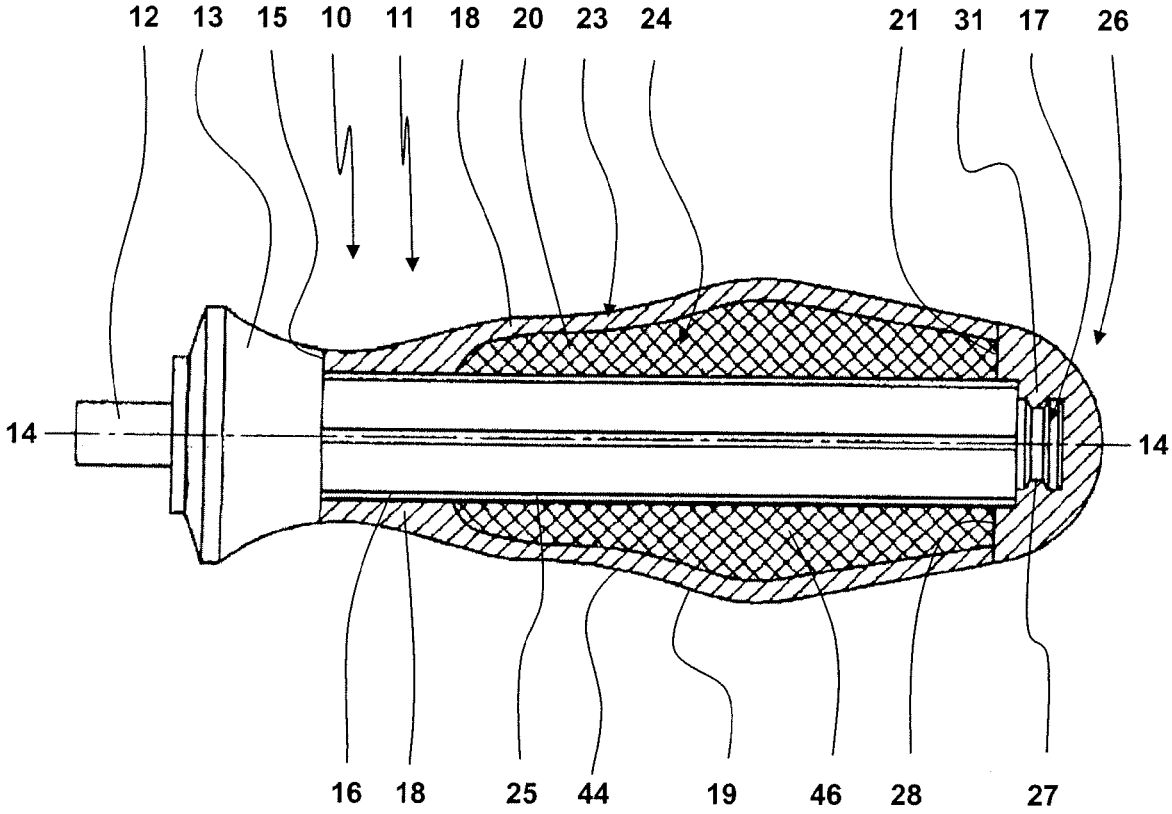
FIG. 9 shows another embodiment of a handle in a longitudinal sectional view.

FIG. 9 shows another embodiment of a screwdriver 11 with a handle 10. Here one single chamber 20 is provided wherein such single chamber extends in a continuous fashion in circumferential direction. The length of such chamber 20 is approximately half up to ⅔ of the length of the handle. The chamber 20 comprises a filling 46 built of an elastic material wherein the chamber might be partially or completely filled. The filling 46 is preferably a soft plastic material and might comprise a porous or non-porous or closed structure. In particular, the filling 46 has a hardness of 10 to 50 Shore A. It is also possible that the hardness of the plastic material varies, e.g. in longitudinal and/or radial direction. The basic idea of providing an elastic material within the chambers is also applicable to the embodiments shown in FIGS. 1 to 7, in particular for one single chamber which extends continuously in circumferential direction or a plurality of chambers.

A handle 10 for a screwdriver 11 with at least one chamber 20 comprising a filling 46 might for example be manufactured on the basis of the following manufacturing processes:

a) According to a first embodiment of a method for manufacturing the handle, in a first step a filling 46 is connected with the core 13. Such connection might be built by injection moulding of the filling 46 upon the core 13 in a mould having a cavity corresponding to the outer contour of the filling 46. It is also possible that the filling 46 is manufactured separately wherein after finishing the hardening process the filling 46 is located at the outer surface of core 13. The filling 46 might be secured with respect to the core 13 by means of frictional engagement, positive engagement and/or by means of an adhesive or bonding. In a subsequent step, the core 13 with the connected filling 46 is positioned within a suitable mould comprising the outer shape of the handle. The cover layer 18 is injection moulded into the hollow space between the core 13 with filling 46 and the cavity providing an adhesive bond between cover layer 18 and filling 46.

b) According to an alternative method for the manufacturing process of the handle, first the cover layer 18 is injection moulded upon the core 13, wherein casting cores are used for forming the chambers 20 within the cover layer 18, see the above explanations. After removal of at least one casting core from the interior of the cover layer 18 and from the at least one chamber 20, the filling 46 is introduced into the at least one chamber 20. In a preferred method, filling 46 is a soft plastic material which is injection-moulded into the chamber 20.

Differing from the embodiment shown in FIG. 9, the filling 46 might also fill only a part of the at least one chamber 20. For one embodiment, the filling 46 might build a radial rib, shoulder or collar located in the middle region of the handle 10. It is also possible that there is a radial gap between filling 46 and cover layer 18 such that the cover layer 18 only contacts filling 46 in case of a radial load being applied leading to an elastic deformation which is larger than the aforementioned gap. In order to provide a desired anisotropy with a large elasticity in radial direction but a large stiffness in circumferential direction, the contact areas in circumferential direction between cover layer 18 and filling 46 might be larger than the contact area acting in radial direction, see also FIG. 4. It is also possible to use a composite material for the filling 46, e.g. built by locating stiff elements within the chambers 20 and injecting a soft plastic material into the chambers 20 covering the stiffening elements and filling the chambers.

Figure 10:
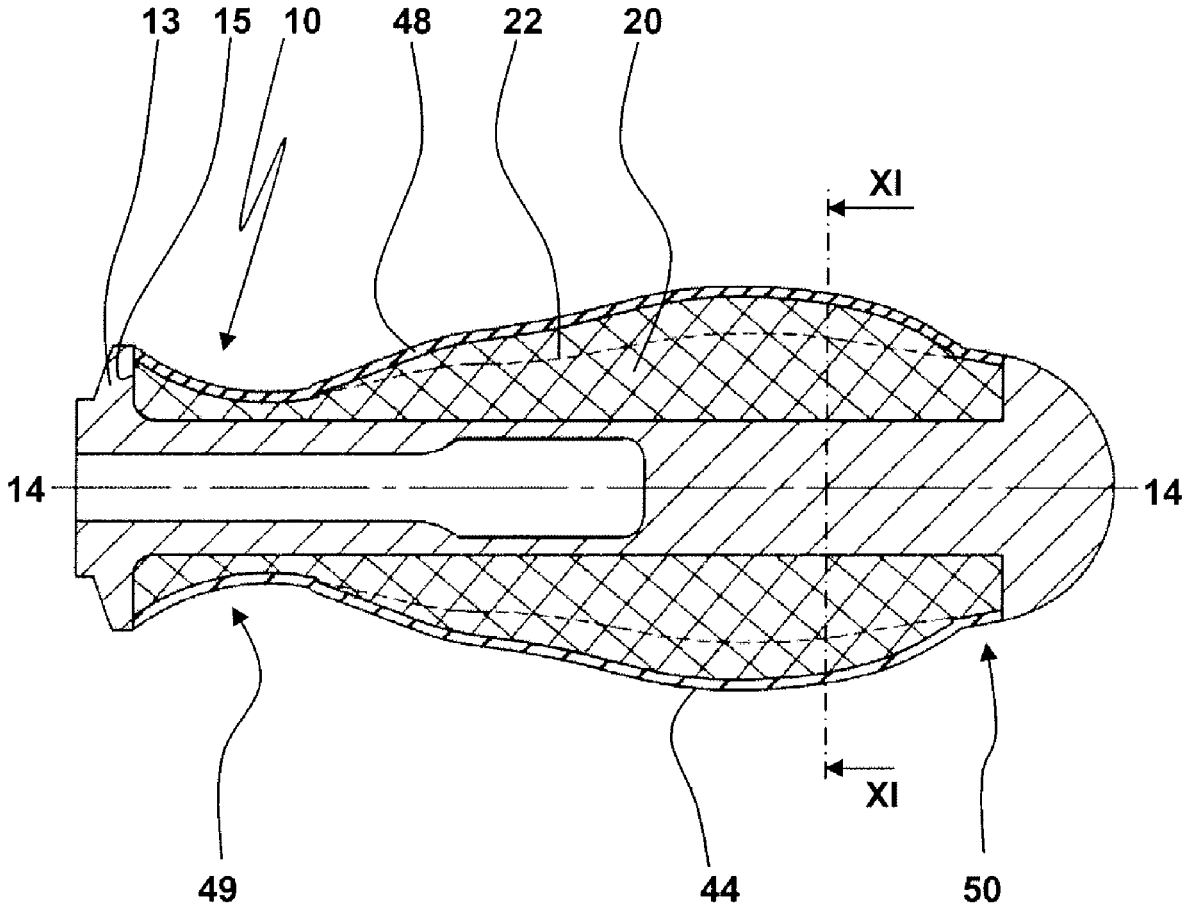
FIG. 10 shows another embodiment of a handle in a longitudinal sectional view.
Figure 11:
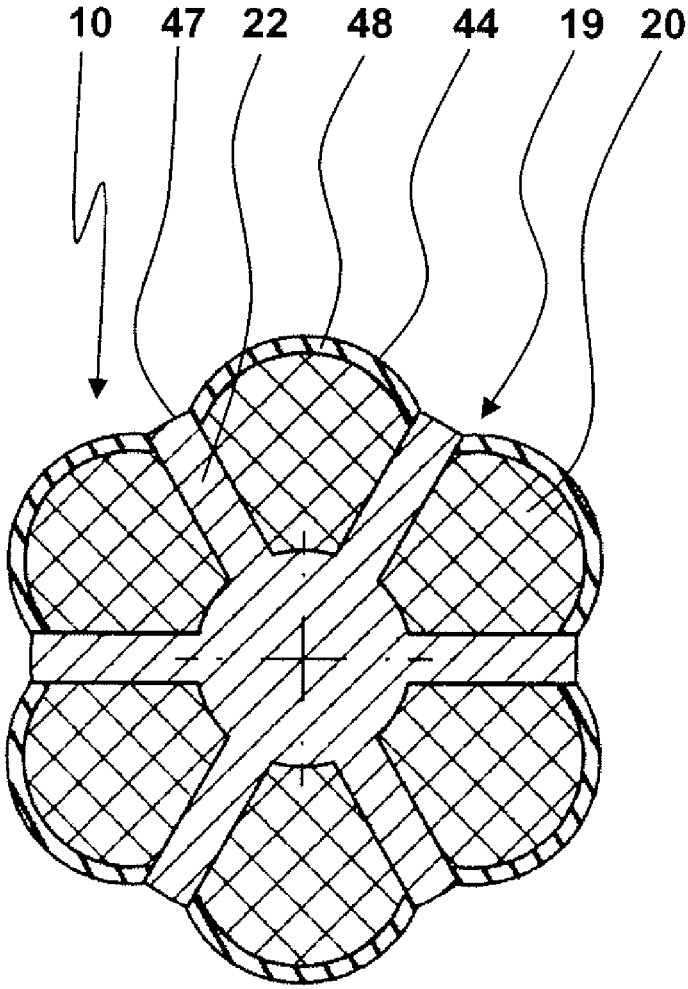
FIG. 11 shows the handle according to FIG. 10 in a cross-sectional view XI-XI.
Figure 12:
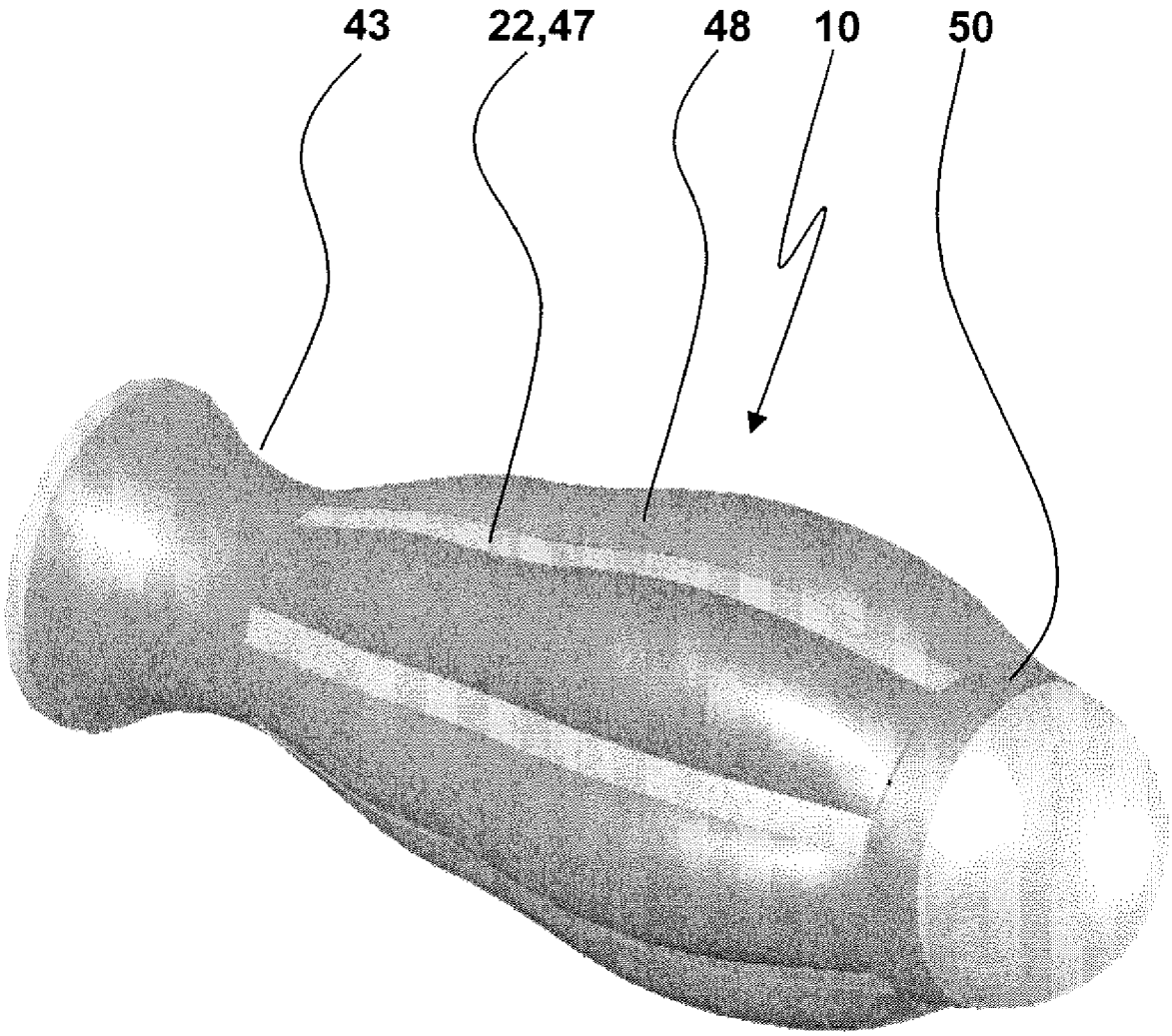
FIG. 12 shows a handle according to FIGS. 10 and 11 in a three-dimensional view.

FIGS. 10 to 12 show another embodiment of a handle 10. For such embodiment, the part of the core 13 with a cylindrical outer surface which is covered by the cover layer 18 comprises ribs 22 oriented in radial outward direction. For the embodiment shown in FIG. 11, six ribs 22 are provided wherein those ribs are distributed in circumferential direction in a uniform and equidistant fashion. The outer surface 19 is built with front surfaces 47 of the ribs 22 extending in longitudinal direction 14-14 of handle 10. The end region of adjacent ribs 22 built by the outer surfaces 47 are connected with each other by means of transitional regions 48. Such transitional regions 48 comprise a constant wall thickness which might be smaller than the wall thickness of the ribs 22. In the cross-sections shown in FIG. 11, the transitional regions build "cushions" and have a convexity which is in a first approximation built with a contour of a segment of a circle. The chambers 20 are limited in radial inner direction by means of the cylindrical outer surface of the core 13 of the handle, in circumferential direction by the ribs 22 and in radial outward direction by means of the transitional regions 48. For the shown embodiment, the core 13 integrally builds the cap. Such design leads to the core 13 in a rough approximation having a longitudinal section which roughly approximates the form of a lying "double-T" or in the shape of a bone. The material located within the chambers 20 might be injected in any suitable mould with a cavity having an inner contour corresponding to the inner contour of the transitional regions 48. In a subsequent manufacturing step, the material building the transitional regions 48 might be injected into another mould having an inner contour that correspond to the outer contour of the transitional regions 48. The material building the transitional regions, and in particular also the material building the ribs 22, has a stiffness which is larger than the stiffness of the material located within the chambers 20.

As can be seen from FIG. 12, the outer surfaces 47 of the ribs 22 do not build part of the outer surface 19 for the whole longitudinal extension of the handle. However, in the front region 49 as well as the rear region 50, the outer surface 19 is built continuously in circumferential direction with the material of the transitional regions 48. The outer surfaces 47 of the ribs 22 are part of the outer surface 19 in the area of the handle comprising the largest diameter and building the main contact area for the hand of a user. The convexity of the transitional regions 48 provide "cushions", wherein such cushions continue in longitudinal direction of the outer surface 19. The cushion-like convexities undergo a deformation in radial inner direction under the loads applied by the hand of the user.

The outer contour of the handle might be different than the shown hexagonal contour. Such differing contour according to some examples might be a circular contour, a foursquare contour, an octagonal contour or an oval contour. The location of the chambers in circumferential direction might also differ from the position shown in the embodiments with the aim of providing a desired radial elasticity.

The chambers shown in the figures might be partially or completely filled with a material selected from the group of materials consisting of a liquid and a gel. At least one of said chambers might comprise a cross-section which is constant in longitudinal direction. Said ribs might be oriented in a radial direction or might be inclined with respect to a radial orientation under an angle of inclination $\alpha$. Ribs might also be provided with differing angles of inclination $\alpha$. The cap might be rotatable and/or might be mounted under positive engagement.

In the figures for different embodiments of the invention, elements having a comparable function, design or comparable properties have been denoted with the same reference numerals.

Many variations and modifications may be made to the preferred embodiments of the invention without departing substantially from the spirit and principles of the invention. All such modifications and variations are intended to be included herein within the scope of the present invention, as defined by the following claims.

I claim:

1. Hand tool handle comprising:

a) a core;

b) an inner region defining a longitudinal axis, said inner region comprising one element selected from the group consisting of ba) chambers located equidistant in a circumferential direction of said handle or bb) one single chamber being continuous in the circumferential direction of said handle, c) an outer region coupled to the inner region and disposed radially outside the selected element of the inner region, said outer region being built by a cover layer, wherein ca) said outer region forms an outer surface of said handle, cb) said outer region is built with a material having a hardness of 40 to 105 Shore A, and cc) said outer region has a first stiffness;

d) wherein said inner region is built in a radial transition region between said core and said cover layer, e) wherein said one single chamber is or said chambers are completely filled with a solid injection moulded plastic material having a porous or non-porous structure and a hardness of 10 to 45 Shore A, f) said hardness of said solid injection moulded plastic material completely filling said one single chamber or said chambers provides said inner region with a second stiffness, said second stiffness being smaller than said first stiffness of the outer region, and g) said outer region, said inner region, said solid injection moulded plastic material completely filling said one single chamber or said chambers, and said core are adhered or bonded to each other by injection moulding.

2. Handle according to claim 1, wherein a stiffness of said handle in a radial direction is smaller than a stiffness of said handle in the circumferential direction.

3. Handle according to claim 1, wherein said inner region comprises more than one chamber.

4. Handle according to claim 1, wherein at least one of said chambers extends approximately in a longitudinal direction of said handle.

5. Handle according to claim 4, wherein at least one of said chambers comprises a linear longitudinal axis.

6. Handle according to claim 4, wherein at least one of said chambers comprises a contour which is curved in a radial direction of the handle along its longitudinal extension.

7. Handle according to claim 6, wherein said contour differs from the contour of said outer surface of said handle.

8. Handle according to claim 6, wherein said contour approximately equals the contour of said outer surface of said handle.

9. Handle according to claim 1, wherein at least one of said chambers comprises a cross-section which changes in a longitudinal direction of the chamber.

10. Handle according to claim 1, wherein said chambers are separated from each other in the circumferential direction by means of ribs.

11. Handle according to claim 10, wherein said ribs are built integrally or bonded with said core of said handle.

12. Handle according to claim 1, wherein said one single chamber comprises or said chambers comprise an opening which is closed by a cap.

13. Handle according to claim 12, wherein said cap comprises at least one ring washer designed and arranged for closing said opening.

14. Handle according to claim 12, wherein said cap is bonded or adhered with at least one of the inner region and outer region.

15. Handle according to claim 1, wherein said chambers are limited in circumferential direction by means of radial oriented ribs and in radial outward direction by means of circumferential transitional regions being built by said cover layer, wherein said outer surface of said handle is built with the radial outer surfaces of said ribs as well as with said circumferential transitional regions.

16. Handle according to claim 15, wherein said ribs and said circumferential transitional regions are built of the same material.

17. Handle according to claim 15, wherein said ribs and said circumferential transitional regions are built with different materials.

18. Handle according to claim 15, wherein in a central region said outer surface of said handle is built with said radial outer surfaces of said ribs and said circumferential transitional regions in an alternating fashion and wherein said handle comprises a front region, wherein in said front region said circumferential transitional regions build one single integral transitional region in circumferential direction of said outer surface of said handle.

19. The handle according to claim 1, wherein the plastic material is elastic.

20. The handle according to claim 1, wherein said one single chamber has or said chambers each have a radial cross-section limited in a radial inward direction by said inner region and limited in a radial outward direction by said outer region, and said inner region and said outer region are unitary in construction.

21. The handle according to claim 1, wherein the core and the cover are made of different materials.

22. Hand tool handle comprising:

a) a core;

b) an inner region defining a longitudinal axis, said inner region comprising one element selected from the group consisting of ba) chambers located equidistant in a circumferential direction of said handle or bb) one single chamber being continuous in the circumferential direction of said handle, c) an outer region coupled to the inner region and disposed radially outside the selected element of the inner region, said outer region being built by a cover layer, wherein ca) said outer region forms said outer surface of said handle, and cb) said outer region is built with a material having a hardness of 40 to 105 Shore A, and cc) said outer region has a first stiffness;

d) wherein said inner region is built radially between said core and said cover layer, e) wherein said one single chamber contains or said chambers contain a solid injection moulded plastic material having a hardness of 10 to 45 Shore A, f) said hardness of said solid injection moulded plastic material provides said inner region with a second stiffness, said second stiffness being smaller than said first stiffness, and g) said outer region, said inner region, said solid injection moulded plastic material completely filling said one single chamber or said chambers, and said core are adhered or bonded to each other.

23. Handle according to claim 22, wherein a stiffness of said handle in a radial direction is smaller than a stiffness of said handle in the circumferential direction.

24. Handle according to claim 22, wherein said inner region comprises more than one chamber.

25. Handle according to claim 22, wherein at least one of said chambers extends approximately in a longitudinal direction of said handle.

26. Handle according to claim 25, wherein at least one of said chambers comprises a linear longitudinal axis.

27. Handle according to claim 25, wherein at least one of said chambers comprises a contour which is curved in a radial direction of the handle along its longitudinal extension.

28. Handle according to claim 27, wherein said contour differs from the contour of said outer surface of said handle.

29. Handle according to claim 27, wherein said contour approximately equals the contour of said outer surface of said handle.

30. Handle according to claim 22, wherein at least one of said chambers comprises a cross-section which changes in a longitudinal direction of the chamber.

31. Handle according to claim 22, wherein said chambers are separated from each other in the circumferential direction by means of ribs.

32. Handle according to claim 31, wherein said ribs are built integrally or bonded with said core of said handle.

33. Handle according to claim 22, wherein said one single chamber comprises or said chambers comprise an opening which is closed by a cap.

34. Handle according to claim 33, wherein said cap comprises at least one ring washer designed and arranged for closing said opening.

35. Handle according to claim 33, wherein said cap is bonded or adhered with at least one of the inner region and outer region.

36. Handle according to claim 22, wherein said chambers are limited in circumferential direction by means of radial oriented ribs and in radial outward direction by means of circumferential transitional regions being built by said cover layer, wherein said outer surface of said handle is built with the radial outer surfaces of said ribs as well as with said circumferential transitional regions.

37. Handle according to claim 36, wherein said ribs and said transitional regions are built of the same material.

38. Handle according to claim 36, wherein said ribs and said circumferential transitional regions are built with different materials.

39. Handle according to claim 36, wherein in a central region said outer surface of said handle is built with said radial outer surfaces of said ribs and said circumferential transitional regions in an alternating fashion and wherein said handle comprises a front region, wherein in said front region said circumferential transitional regions build one single integral transitional region in circumferential direction of said outer surface of said handle.

* * * * *